US006631709B2

(12) United States Patent
Carter et al.

(10) Patent No.: US 6,631,709 B2
(45) Date of Patent: Oct. 14, 2003

(54) ARCHERY BOWSTRING BACK TENSION RELEASE

(75) Inventors: Jerry C. Carter, St. Anthony, ID (US); Jeffrey B. Weissert, Washougal, WA (US); Donald S. Kudlacek, Longview, WA (US)

(73) Assignee: Carter Enterprises, Inc., St. Anthony, ID (US)

( * ) Notice: Subject to any disclaimer, the term of this patent is extended or adjusted under 35 U.S.C. 154(b) by 0 days.

(21) Appl. No.: 09/938,028

(22) Filed: Aug. 22, 2001

(65) Prior Publication Data

US 2003/0037778 A1 Feb. 27, 2003

(51) Int. Cl.[7] ..... F41B 5/18
(52) U.S. Cl. ..... 124/35.2
(58) Field of Search ..... 124/35.2

(56) References Cited

U.S. PATENT DOCUMENTS 3,853,111 A * 12/1974 Stanislawski et al.
3,965,884 A * 6/1976 Killian
D255,824 S * 7/1980 MacWilliams et al.
4,620,524 A * 11/1986 Saunders
5,692,490 A * 12/1997 Walker ..... 124/35.2
5,694,915 A * 12/1997 Summers ..... 124/35.2

* cited by examiner

*Primary Examiner*—John A. Ricci
(74) *Attorney, Agent, or Firm*—Olson and Olson

(57) ABSTRACT

An archery bowstring release includes a hand grip having a forwardly extending post pivotally mounting a bowstring hook member releasably engaged by a locking mechanism that serves to adjust the position of the hook on the hook member for releasing a bowstring and projecting an arrow to a target. In one embodiment, the hook member is secured adjustably to the post. In another embodiment, the hook member is mounted pivotally on a support frame carried pivotally on a cam member pivoted to the post and arranged to engage the hook member for release by pivotal movement of the support frame through a small angle by adjustment of the cam member rotationally relative to the post. The hook member may be secured adjustably to the post or cam member either by a pin and groove assembly or by a worm gear engaging a gear on the hook or cam member.

13 Claims, 5 Drawing Sheets

ARCHERY BOWSTRING BACK TENSION RELEASE

BACKGROUND OF THE INVENTION

This invention relates to archery bows, and more particularly to a novel bowstring release.

Release devices are employed by archers to protect the fingers from injury and to enable release of a bowstring with minimum adverse influence of an archer's involuntary movements during the aiming and bowstring release actions.

In manner analogous to the aiming and firing of a rifle or handgun, in which involuntary movements of the hand, finger or other component of the body results in inaccurate striking of a target, so also do such involuntary movements result in inaccurate hitting of an archery target with an arrow. A major source of such errors stems from the mental anticipation of moving the fingers of a hand to pull the trigger of a gun or to release an archery bowstring. In both activities the mental instructions to the fingers induce anxiety and tension in those and other components of the body, causing involuntary movements which adversely affect the accuracy of aiming at and striking the target.

U.S. Pat. Nos. 5,694,915; 3,965,884; and 3,853,111 disclose triggerless bowstring release devices in which a bowstring hook is arranged to release a bowstring by pivoting the device laterally, by movement of the archer's hand or fingers. However, none of these devices provides faithfully reproducible, substantially infinite degrees of sensitivity adjustments for insuring consistent shooting accuracy.

SUMMARY OF THE INVENTION

This invention provides a bowstring release in which a bowstring hook member is held releasably in a reproducibly repeatable locked position against a locking member until the hook member is moved a distance sufficient to disengage from the locking member, the distance to be moved being adjustable for variable sensitivity and the disengagement being unpredictable, whereby to avoid involuntary hand and body movements.

It is the principal objective of this invention to provide a bowstring release that overcomes the aforementioned limitations and disadvantages of prior bowstring releases.

Another objective of this invention is the provision of a bowstring release of the class described that allows aiming and release of an arrow from an archery bow without adverse influence from involuntary movements of the archer.

Still another objective of this invention is to provide a bowstring release of the class described in which release from a bowstring is achieved by movement of a bowstring hook member from a locked position holding a bowstring in drawn condition to a bowstring release position, without the archer knowing in advance at what position or condition the bowstring is released.

A further objective of this invention is the provision of a bowstring release of the class described in which movement of a bowstring hook member from locked to release position is adjustable, whereby to vary the position of draw and sensitivity of bowstring release, and thereby further remove from the archer the knowledge of the position of bowstring release.

A still further objective of this invention is the provision of a bowstring release of the class described which is of simplified construction for economical manufacture, which is precise in its operation and provides faithfully reproducible, substantially infinite degrees of sensitivity of release throughout a predetermined range.

The foregoing and other objects and advantages of this invention will appear from the following detailed description, taken in connection with the accompanying drawings of preferred embodiments.

DESCRIPTION OF THE PREFERRED EMBODIMENTS

Figure 1:
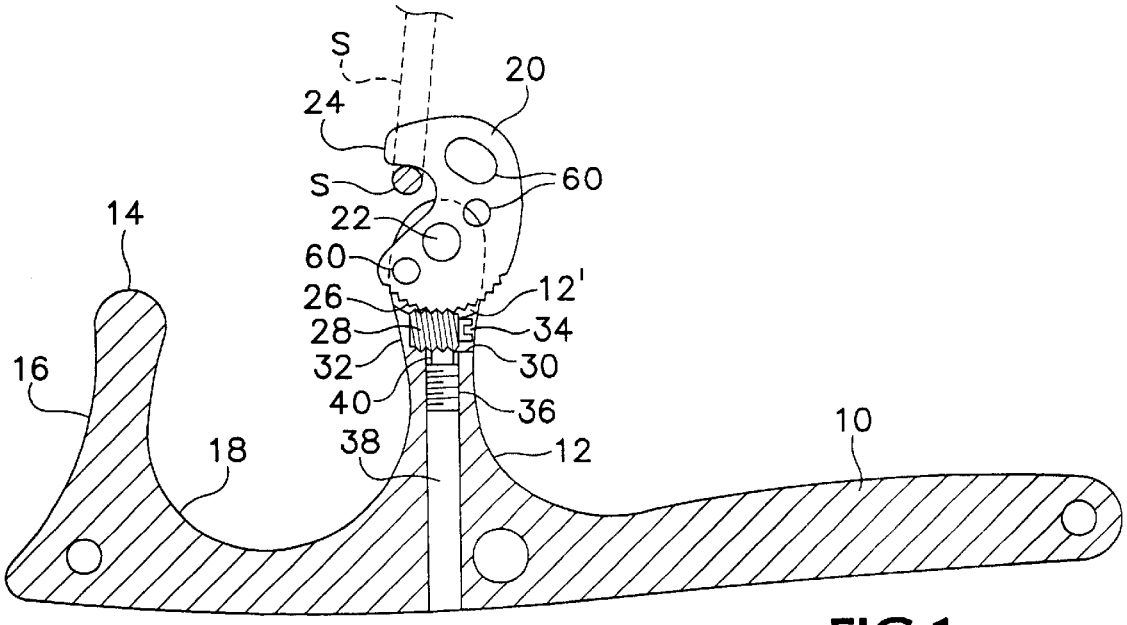
FIG. 1 is a longitudinal sectional view of a first embodiment of bowstring back tension release embodying the features of this invention, showing details of internal construction of a first form of adjustment mechanism for varying the distance of movement of the hook member of the release.

The drawings illustrate the common structural features of all embodiments to include a hand grip member 10 from which a center post 12 extends forwardly, intermediate the ends of the hand grip member. An end post 14 is provided with a thumb surface 16 by which to support a thumb of the archer's hand. An index finger pocket 18 is formed between the center post and end post.

Figure 2:
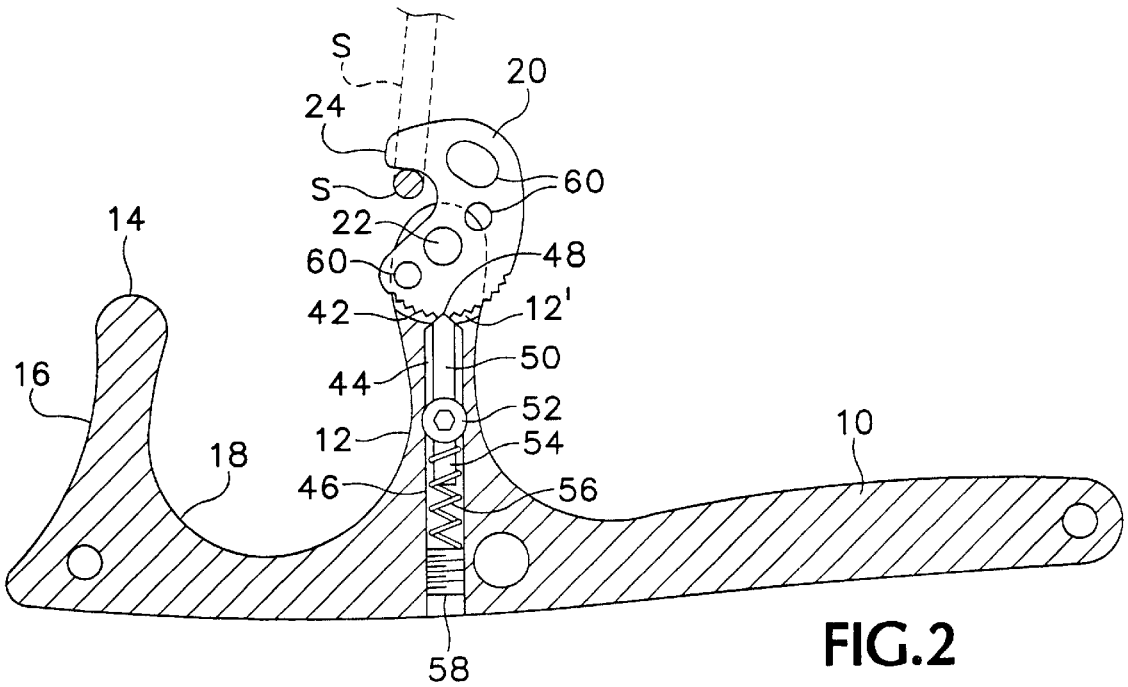
FIG. 2 is a longitudinal cross section, similar to FIG. 1, showing details of internal construction of a second form of adjustment mechanism for varying the distance of movement of the hook member of the release.

Referring now primarily to FIGS. 1 and 2 of the drawings, a bowstring hook member 20 is disposed between the bifurcated end tabs 12' of the center post and is secured to the post by pivot pin 22 which extends through the end tabs and an intermediate portion of the hook member. The outer end of the hook member is provided with a bowstring retaining hook 24 for capturing a bowstring S.

FIG. 1 shows the hook member 20 to have an arcuate inner portion provided with a gear thread 26 throughout a predetermined arc of pivotal movement of the hook member. A worm screw 28 is mounted in a transverse retainer bore 30 which is open at one end and closed at the opposite end 32. The worm screw is provided with a screwdriver slot 34 which is exposed through the open end of the bore and serves to receive a screwdriver tool for rotating the worm screw and correspondingly rotating the hook member 20 about the axis of the pivot pin 22.

The worm screw is retained in desired position of rotational adjustment by means of a clamp screw 36 received in a threaded portion of the bore 38 which extends forwardly from the rear side of the hand grip 10. A soft plug 40 of plastic or other suitable material on the forward end of the clamp screw serves to bear against the worm screw to secure it frictionally against rotation from its desired setting.

In FIG. 2 the end of the bowstring hook member 20 opposite the hook 24 is configured arcuately and provided with a plurality of closely spaced sensitivity grooves 42 extending throughout a predetermined arc of adjustment. An elongated sensitivity pin 44 is mounted slidably in a bore 46 which extends from the rearward side of the hand grip member 10 forwardly through the center post 12 to the bifurcated tabs 12'. The pin is provided with a pointed forward edge 48. The pin is round in cross section and provided with an elongated flat 50 which is engageable releasably by a stabilizer and lock screw 52. The screw bears against the flat 50 to prevent rotation of the pin, and may be turned down to bear firmly against the flat to lock the pin against longitudinal movement when the pin edge 48 is secured in the desired one of the sensitivity grooves 42.

The rearward end of the pin 44 is provided with a reduced diameter portion 54 which serves to center a coil spring 56 at its forward end. The rearward end of the coil spring engages an abutment screw 58 received in a threaded section of the bore 46. The coil spring thus serves to retain the pointed edge 48 of the pin against the grooves 42 retractably to allow pivotal adjustment of the hook member 20, for sensitivity adjustment, as explained more fully hereinafter.

The hook member 20 may be provided with holes 60 for the mounting of a conventional rope release, as will be understood.

Figure 3:
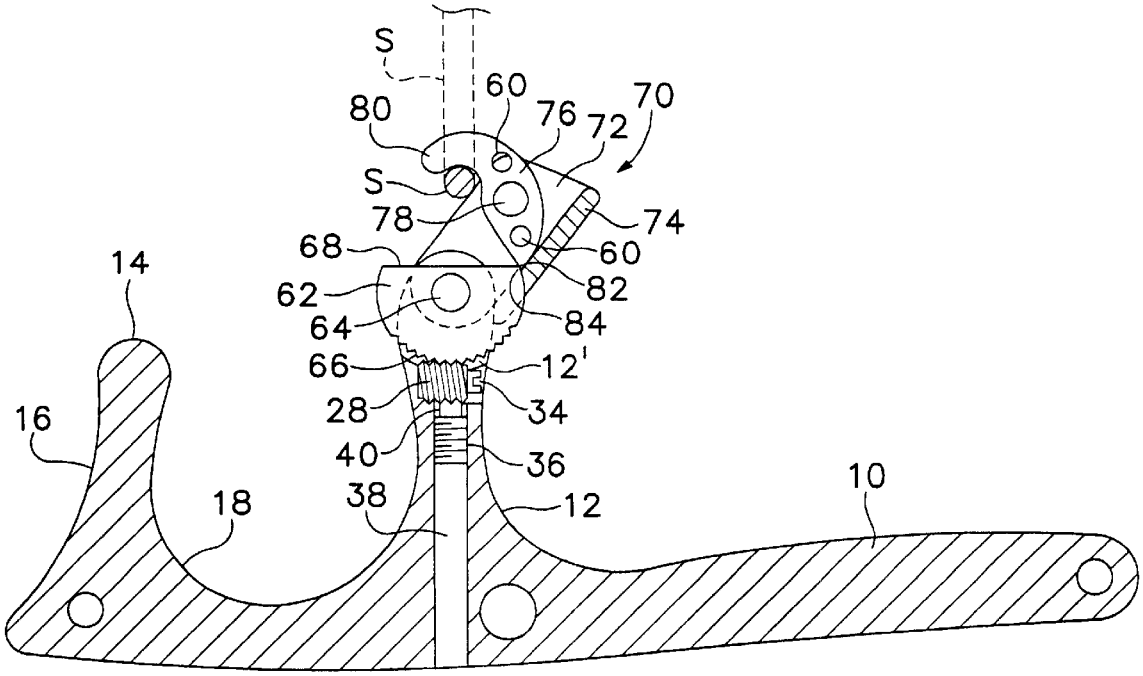
FIG. 3 is a longitudinal cross section of a second embodiment of bowstring back tension release embodying features of this invention, the adjustment mechanism being the same as in FIG. 1.
Figure 4:
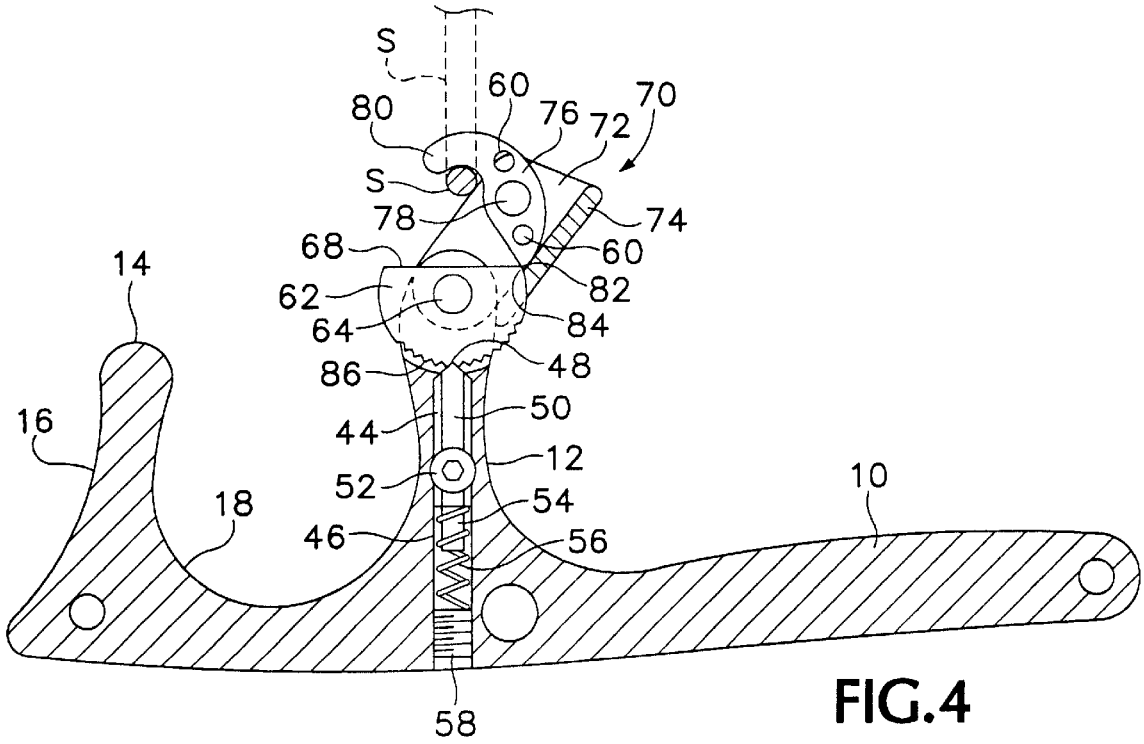
FIG. 4 is a longitudinal cross section of the hook release mechanism of FIG. 3 but with the adjustment mechanism of FIG. 2.
Figure 5:
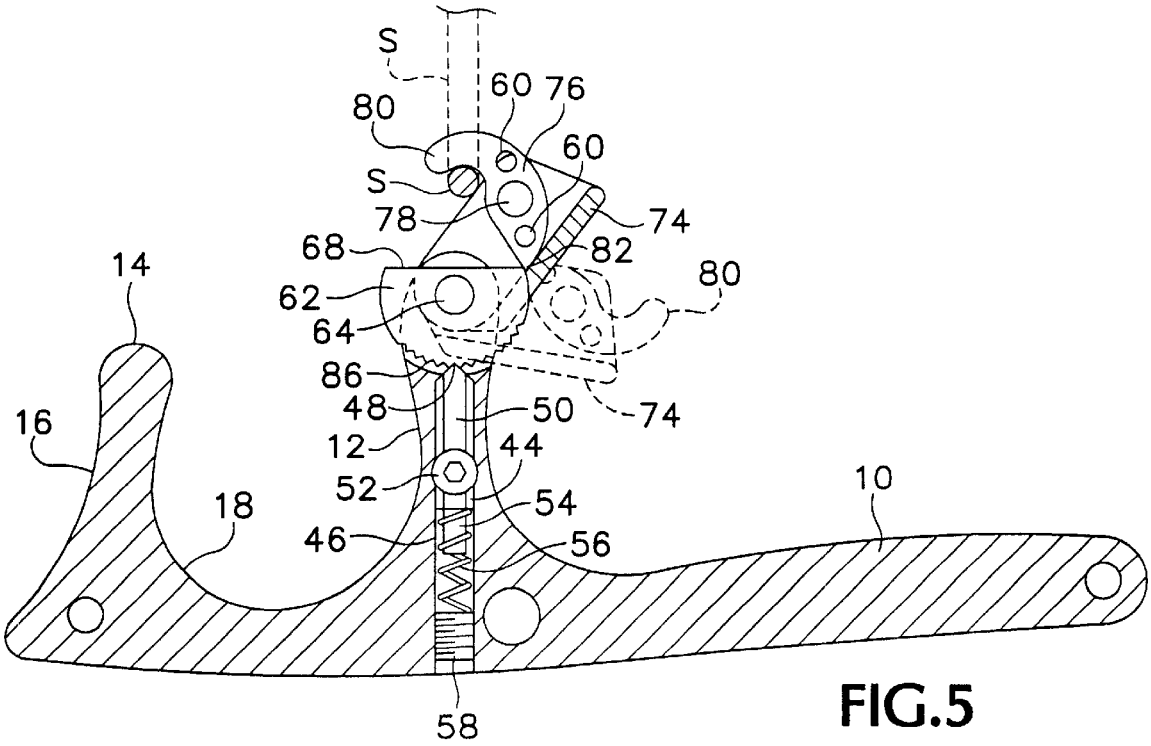
FIG. 5 is a longitudinal cross section similar to FIG. 4 showing in full lines the positions of the components securing an archery bowstring to the hook component in the latched position for drawing a bowstring, and showing the hook release position in broken lines.

Referring now to the embodiment illustrated in FIGS. 3–5, a cam member 62 is positioned between the bifurcated end tabs 12' of the center post 12 and is secured therein by pivot pin 64. In the embodiment illustrated in FIG. 3, the rearward portion of the cam member is arcuate in configuration and provided with a gear thread 66 for cooperative engagement with a worm screw 28, as described hereinbefore. The forwardly facing side 68 of the cam member 62 is flat, and serves to engage a hook member described hereinafter.

A hook member support frame 70 is provided with spaced side walls 72 and back wall 74. The side walls are provided with registering openings for reception of the pivot pin 64. The hook support frame thus is pivotable about the axis of pivot pin 64, independently of the cam member 62.

A hook member 76 is positioned between the support frame side walls 72 on pivot pin 78. The forward end of the hook member is provided with a hook 80 configured to retain an archery bowstrings. The rearward end of the hook member forms a finger 82 which releasably engages the cam member 62 adjacent the back wall 74 of the hook support frame 70. The degree of interengagement between the finger and forward side 68 of the cam member is adjustable by rotation of the cam member by the worm screw 28, in the manner previously described. The cam member preferably is provided with a notch 84 adjacent the flat side 68 of the cam member confronting the hook member finger 82, to provide the archer with a "click" sound alert that the position of hook release is pending.

In FIG. 4 the assembly of cam member 62, hook support frame 70 and hook member 76 are the same as in FIG. 3, with the exception that the arcuate rearward end of cam member 62 is provided with sensitivity grooves 86 for association with sensitivity pin 44 and related components shown in FIG. 2.

FIG. 5 illustrates the operation of the release embodiment of FIGS. 3 and 4. With the cam member 62 rotated and secured in a desired position of sensitivity of hook release, the hook support frame 70 is rotated counterclockwise about the axis of pivot pin 64 until the finger 82 of the hook member 76 can be brought into abutment with the adjacent end of the flat forward end 68 of the cam member. The hook support frame 70 then is rotated clockwise to draw the finger 82 of the hook member 70 into engagement with the cam member, whereby to lock the hook member against release. The forward hook 80 then may be brought into retaining engagement with a bowstring and the release assembly pulled rearward to a position approaching full draw of the bowstring. As the full draw position is approached, the rotation of the arm and hand of the archer rotates naturally to a position at which the tension in the back of the archer causes a further slight rotation of the hand and consequent lateral tilting of the hand grip member 10. This movement is accompanied by a slight counterclockwise rotation of the hook support frame 70 and corresponding retracting movement of the finger 82 of the hook member 76 from the cam 62.

If the alert notch 84 is provided, the finger 82 of the hook member first snaps into the notch, giving the archer an audible indication of the pending point of release of the hook member. A further slight, but imperceptible movement of the archer's arm and hand to complete the full draw position, results in the finger being disengaged from the can member, whereupon the hook member is instantly released and rotated to the broken line position of FIG. 5.

The structural arrangement illustrated in FIGS. 3–5 is uniquely effective in allowing an archer to bring an archery bow to full draw and subsequent release of the bowstring at an unpredictable position, thereby avoiding all involuntary movements which mental anticipation would otherwise induce anxiety and tension, resulting in adversely effecting the accuracy of aiming at and striking a target.

In the embodiment of FIGS. 1 and 2, the hook member 20 is adjustable to a position of angular rotation about the axis of pivot pin 22, either by the worm screw 28 or the sensitivity pin 44. It is the movement of the archer's arm and hand at the position approaching full draw that the final condition of back tension in the archer causes a slight rotation of the archer's arm and hand to tilt the hand grip member 10 laterally to an extent allowing the bowstrings to slide off the hook 24. The degree of sensitivity at which this disengagement occurs is adjustable throughout the substantially infinite number of increments of rotation of the hook member 20 through the predetermined arc afforded by the sensitivity gear 26 or sensitivity grooves 42.

Figure 6:
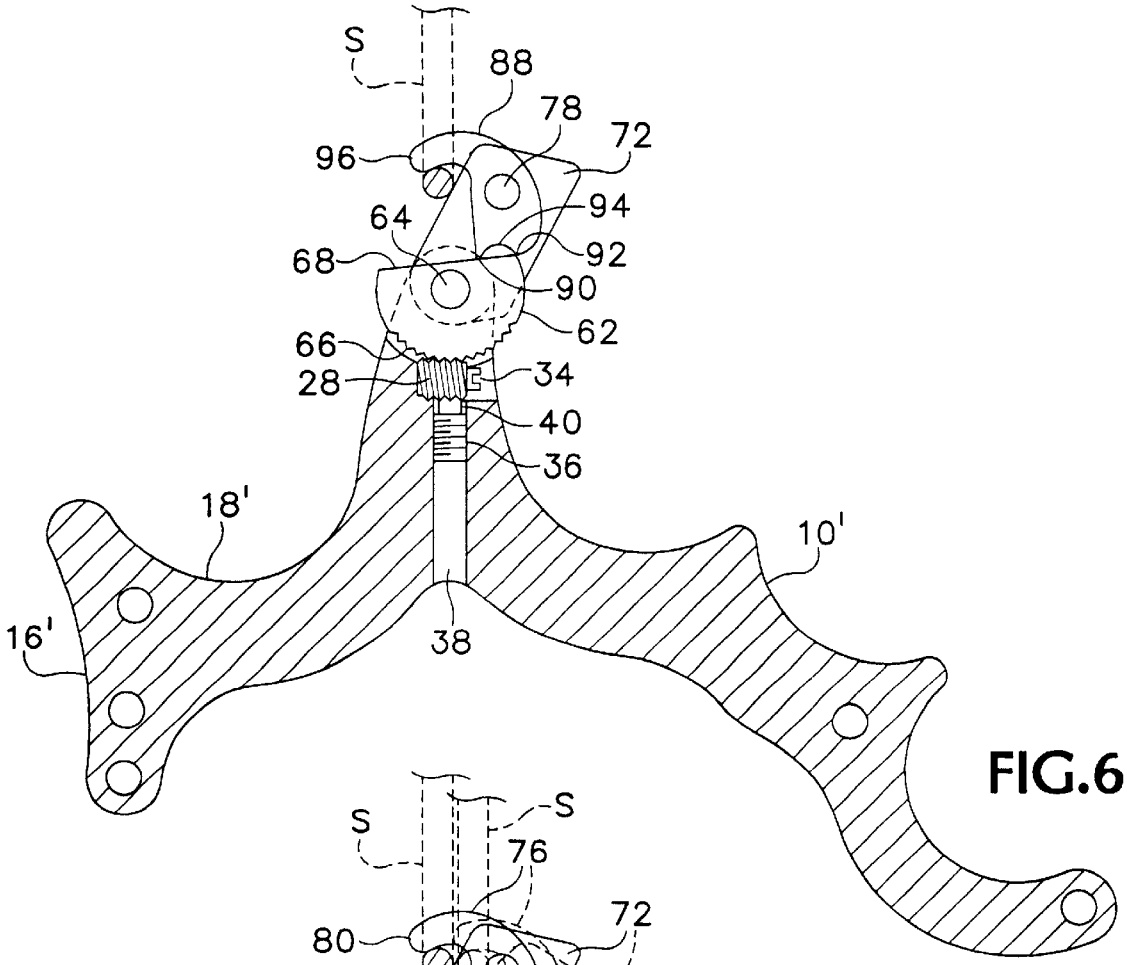
FIG. 6 is a longitudinal cross section of a third embodiment of bowstring back tension release embodying features of this invention, the adjustment mechanism being the same as in FIG. 1.
Figure 7:
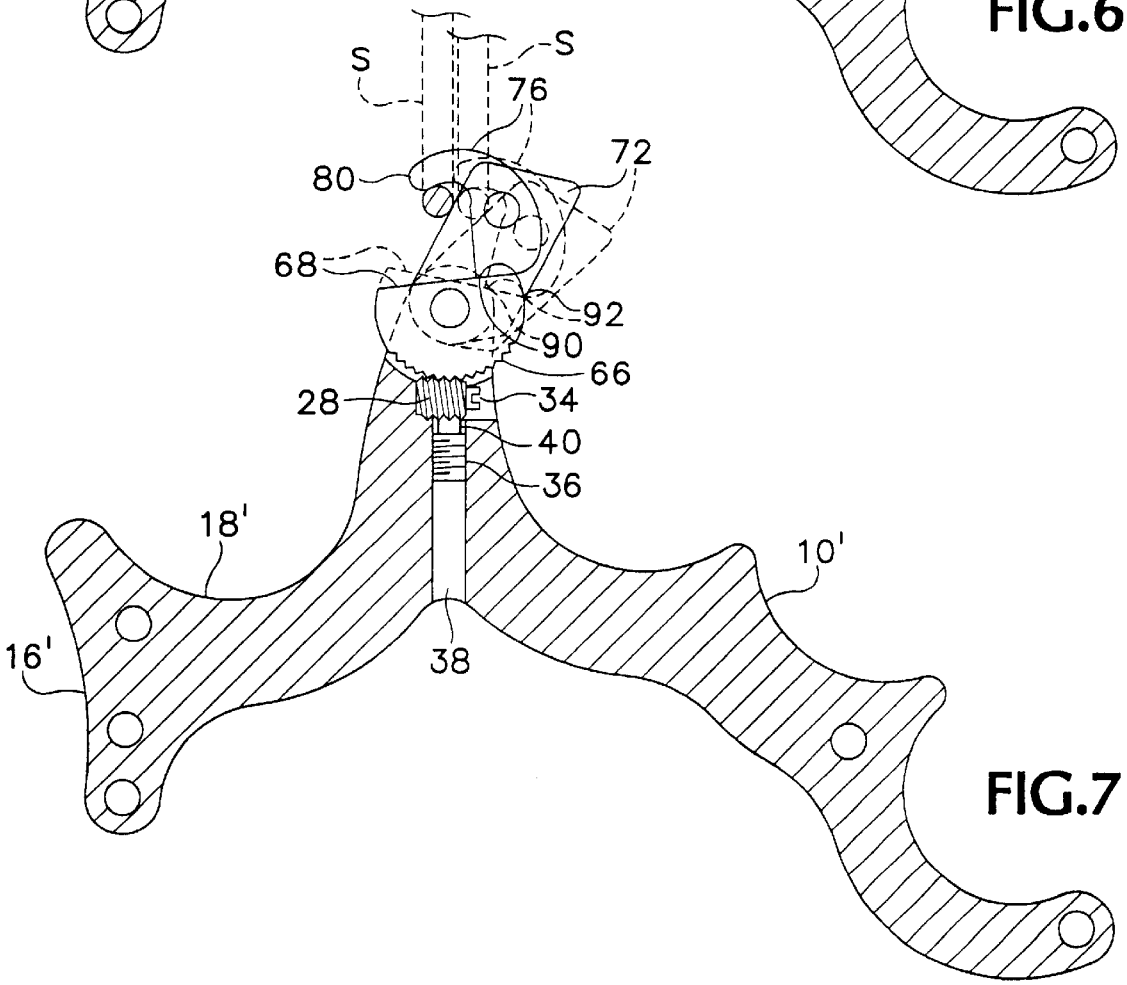
FIG. 7 is a longitudinal cross section similar to FIG. 6 showing in broken lines adjustment of the hook member and associated components to a more sensitive release position of the bowstring.

The embodiment of FIGS. 6 and 7 is similar to the embodiment of FIG. 3 but with a hand grip member 10' shaped to fit the contour of the fingers of an archer's hand and to facilitate the lateral rolling of the hand grip member.

The hook member 88 also is provided with a stop 90 spaced from the finger 92 by an intermediate cavity 94. The stop 90 bears against the forward flat cam side 68 and cam 62 is rotated by the worm gear 28 to adjust desired overlapping engagement with the edge of cam 62, to provide the corresponding degree of sensitivity of bowstring release from the hook 96. In FIG. 7 the broken lines show rotation of the cam 62, frame 70 and hook member 76 clockwise to positions affording a more sensitive release of bowstring S from hook 96.

Figure 8:
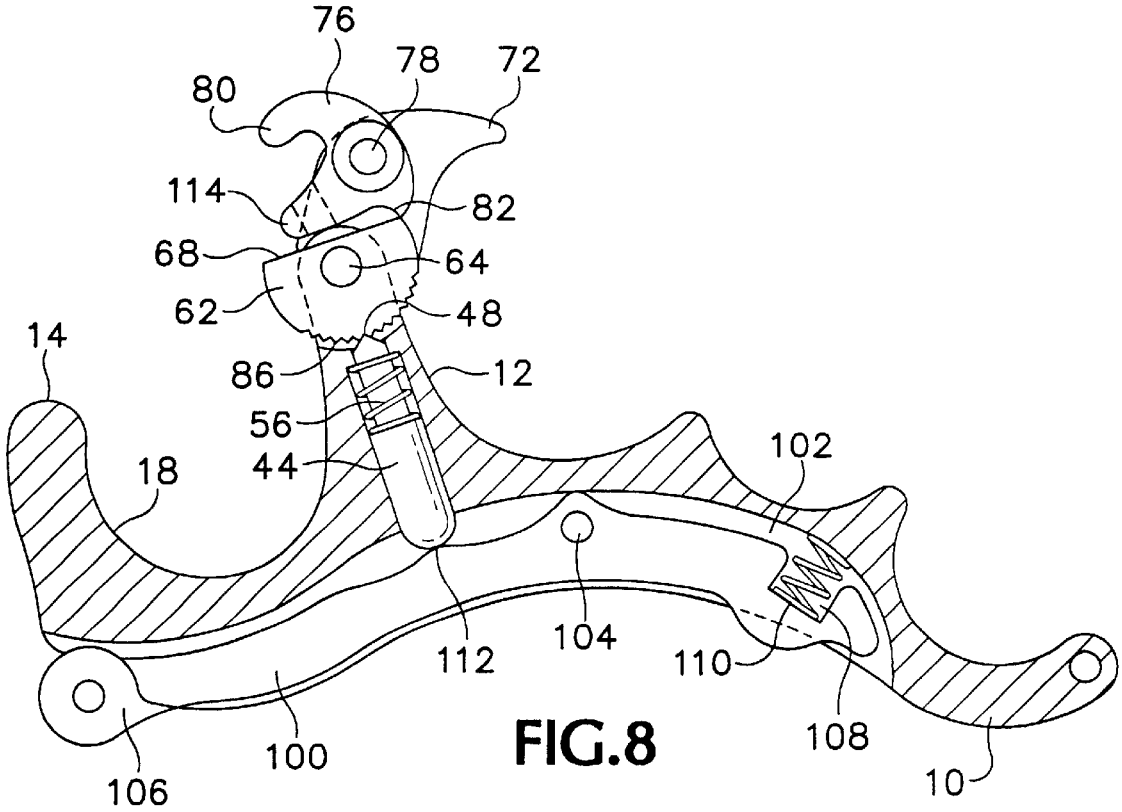
FIG. 8 is a longitudinal cross section of a fourth embodiment of bowstring back tension release embodying features of this invention, the structure being similar to FIG. 4 but including a positive safety mechanism for the hook. The components are shown in the bowstring retaining position.
Figure 9:
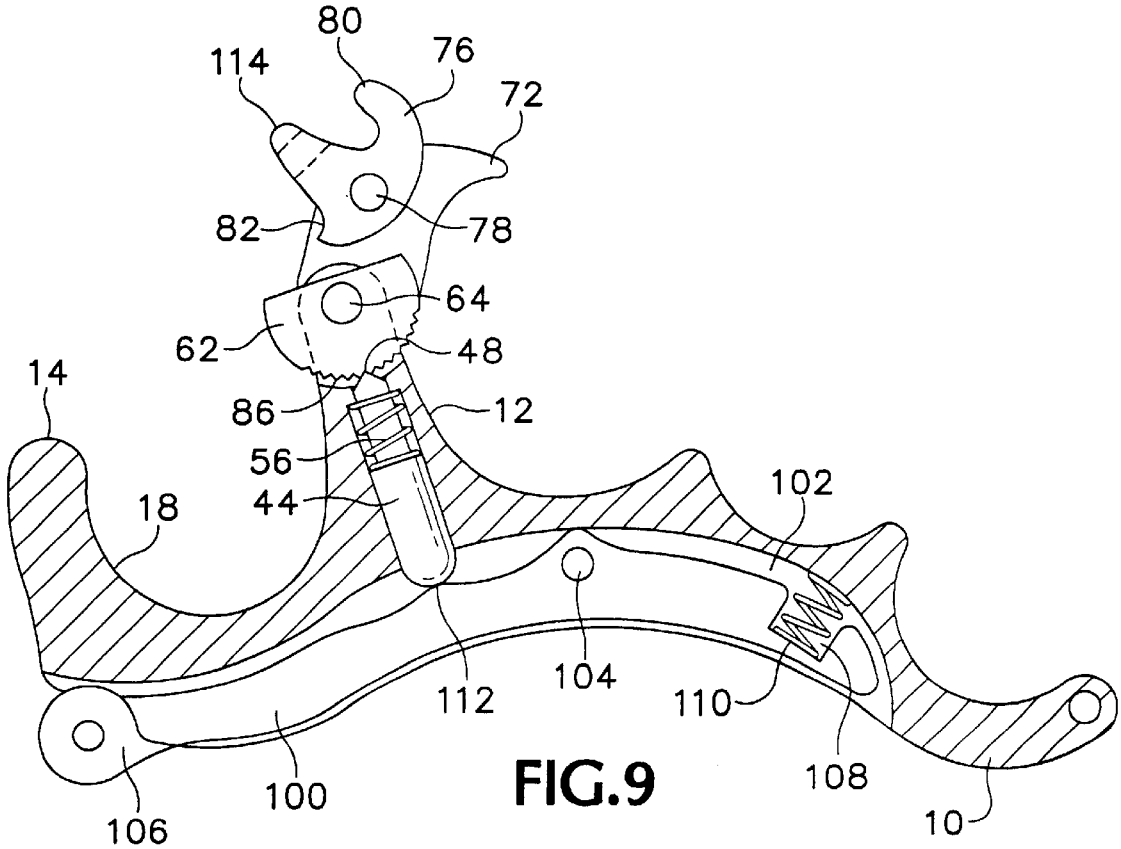
FIG. 9 is a longitudinal cross section of the fourth embodiment shown in FIG. 8, but with the components in the bowstring released condition.

The embodiment of FIGS. 8 and 9 is similar in structural configuration to that of FIG. 4, but with the addition of a positive safety mechanism for preventing premature release of the hook 76. The safety mechanism includes a safety lever 100 contained freely in a slot 102 in the hand grip member 10 and secured intermediate its ends on pivot pin 104. One end of the safety lever is configured with a thumb piece 106 by which the thumb of an archer may be used to pivot the lever. A cavity 108 adjacent the end of the lever opposite the thumb piece 106 contains and seats one end of a coil spring 110 the opposite end of which abuts the bottom side of the slot 102. Intermediate the pivot pin 104 and thumb piece 106 the lever 100 has a forwardly projecting node 112 arranged to engage the rearward end of pin 44. Pivotal movement of the lever thus serves to extend or retract the pin relative to the cam member 62.

When the thumb piece 106 is drawn rearward, against the resilient resistance of coil spring 110, safety lever 100 is rotated counterclockwise and the pointed end 48 of pin 44 is retracted from the groove 86 in cam member 62. The cam member thereupon is free to rotate to the position predetermined by the adjustment of the hook screw 114 which has a threaded shank received in a threaded bore in the hook member 76. The hook screw establishes the amount of sear engagement between the cam member 62 and hook member 76.

The spring 110 urges the safety lever 100 resiliently clockwise to its operative position in which the raised node 112 engages pin 44 and moves its pointed end 48 into engagement with one of the sensitivity grooves 86 in the arcuate rearward end of cam member 62. The release then may be rotated by motion of the archer's hand until the cam member 62 is moved out from under the hook member 76, thereby releasing the bowstring and projecting the arrow to its target.

It will be apparent to those skilled in the art that various changes may be made in the size, shape, type, number and arrangement of parts described hereinbefore. For example, the safety lever mechanism may be incorporated in the previously described embodiments by modification of the configurations of the pins 44 to enable their operative association with the node 112 on the lever 100. This and other modifications may be made without departing from the spirit of this invention and the scope of the appended claims.

We claim:

1. An archery bowstring release, comprising:

a) a hand grip member, b) a post extending forwardly from the hand grip member, c) a hook member having a bowstring-engaging hook, d) a pivot pin on the post mounting the hook member for rotation about the axis of the pivot pin, and e) an arcuate arrangement of a plurality of closely spaced grooves on the end of the hook member opposite said hook, and a pin mounted on the post and releasably engageable selectively with said grooves for securing the hook member in a predetermined position of adjustment.

2. The archery bowstring release of claim 1 including a safety member mounted on the hand grip member for movement between an operative position engaging and securing said pin in engagement with one of said grooves, and a released position retracted from said groove.

3. An archery bowstring release, comprising:

a) a hand grip member, b) a post extending forwardly from the hand grip member, c) a hook member having a bowstring-engaging hook, d) a cam member mounted pivotally on the post, a frame member mounted pivotally on the post for rotation about the cam member, and a pivot mounting the hook member on the frame member with the end of the hook member opposite the hook being releasably engageable with the cam member upon rotation of the frame member, and e) an arcuate arrangement of a gear thread on the end of the hook member opposite said hook, and a worm gear mounted on the post and engaging the gear thread for securing the hook member in a predetermined position of adjustment.

4. An archery bowstring release, comprising:

a) a hand grip member, b) a post extending forwardly from the hand grip member, c) a hook member having a bowstring-engaging hook, d) a cam member mounted pivotally on the post, a frame member mounted pivotally on the post for rotation about the cam member, and a pivot mounting the hook member on the frame member with the end of the hook member opposite the hook being releasably engageable with the cam member upon rotation of the frame member, and e) an arcuate arrangement of a plurality of closely spaced grooves on the cam member, and a pin on the post releasably engageable selectively with said grooves for securing the cam member in a predetermined position of rotational adjustment.

5. The archery bowstring release of claim 4 including a safety member mounted on the hand grip member for movement between an operative position engaging and securing said pin in engagement with one of said grooves, and a released position retracted from said groove.

6. An archery bowstring release, comprising:

a) a hand grip member, b) a post extending forwardly from the hand grip member, c) a hook member having a bowstring-engaging hook, d) pivot means operatively interengaging the hook member and post for adjusting the angular position of the hook member relative to the post through substantially infinite increments over a predetermined range to release the bowstring upon lateral tilting of the hand grip member to a substantially unpredictable degree, e) securing means operatively interengaging the hook member and post for securing the hook member in angular position relative to the post, and f) a safety member mounted on the hand grip member for movement between an operative position securing said hook member against pivotal movement, and a released position enabling pivotal movement.

7. An archery bowstring release, comprising:

a) a hand grip member, b) a post extending forwardly from the hand grip member, c) a hook member having a bowstring-engaging hook, d) pivot means operatively interengaging the hook member and post for adjusting the angular position of the hook member relative to the post through substantially infinite increments over a predetermined range to release the bowstring upon lateral tilting of the hand grip member to a substantially unpredictable degree, the pivot means comprising a cam member mounted pivotally on the post, a frame member mounted pivotally on the post for rotation about the cam member, and a pivot mounting the hook member on the frame member with the end of the hook member opposite the hook being releasably engageable with the cam member upon rotation of the frame member, and e) securing means operatively interengaging the hook member and post for securing the hook member in angular position relative to the post.

8. An archery bowstring release, comprising:

a) a hand grip member, b) a post extending forwardly from the hand grip member, c) a hook member having a bowstring-engaging hook, d) pivot means operatively interengaging the hook member and post for adjusting the angular position of the hook member relative to the post through substantially infinite increments over a predetermined range to release the bowstring upon lateral tilting of the hand grip member to a substantially unpredictable degree, the pivot means comprising a pivot pin on the post mounting the hook member for rotation about the axis of the pivot pin, and the securing means comprises an arcuate arrangement of a plurality of closely spaced grooves on the end of the hook member opposite said hook, and a pin mounted on the post and releasably engageable selectively with the grooves for securing the hook member in a predetermined position of adjustment, and e) securing means operatively interengaging the hook member and post for securing the hook member in angular position relative to the post.

9. The archery bowstring release of claim 8 including a safety member mounted on the hand grip member for movement between an operative position engaging and securing said pin in engagement with one of said grooves, and a released position retracted from said groove.

10. An archery bowstring release, comprising:

a) a hand grip member, b) a post extending forwardly from the hand grip member, c) a hook member having a bowstring-engaging hook, d) pivot means operatively interengaging the hook member and post for adjusting the angular position of the hook member relative to the post through substantially infinite increments over a predetermined range to release the bowstring upon lateral tilting of the hand grip member to a substantially unpredictable degree, the pivot means comprising a pivot pin on the post mounting the hook member for rotation about the axis of the pivot pin, and e) securing means operatively interengaging the hook member and post for securing the hook member in angular position relative to the post, the securing means comprising an arcuate arrangement of a gear thread on the end of the hook member opposite said hook and a worm gear mounted on the post and engaging the gear thread for securing the hook member in a predetermined position of adjustment.

11. An archery bowstring release, comprising:

a) a hand grip member, b) a post extending forwardly from the hand grip member, c) a hook member having a bowstring-engaging hook, d) pivot means operatively interengaging the hook member and post for adjusting the angular position of the hook member relative to the post through substantially infinite increments over a predetermined range to release the bowstring upon lateral tilting of the hand grip member to a substantially unpredictable degree, the pivot means comprising a cam member mounted pivotally on the post, a frame member mounted pivotally on the post for rotation about the cam member, and a pivot mounting the hook member on the frame member with the end of the hook member opposite the hook being releasably engageable with the cam member upon rotation of the frame member, and e) securing means operatively interengaging the hook member and post for securing the hook member in angular position relative to the post, the securing means comprising an arcuate arrangement of a plurality of closely spaced grooves on the cam member, and a pin mounted on the post and releasably engageable selectively with said grooves for securing the cam member in a predetermined position of adjustment.

12. The archery bowstring release of claim 11 including a safety member mounted on the hand grip member for movement between an operative position engaging and securing said pin in engagement with one of said grooves, and a released position retracted from said groove.

13. An archery bowstring release, comprising:

a) a hand grip member, b) a post extending forwardly from the hand grip member, c) a hook member having a bowstring-engaging hook, d) pivot means operatively interengaging the hook member and post for adjusting the angular position of the hook member relative to the post through substantially infinite increments over a predetermined range to release the bowstring upon lateral tilting of the hand grip member to a substantially unpredictable degree, the pivot means comprising a cam member mounted pivotally on the post, a frame member mounted pivotally on the post for rotation about the cam member, and a pivot mounting the hook member on the frame member with the end of the hook member opposite the hook being releasably engageable with the cam member upon rotation of the frame member, and e) securing means operatively interengaging the hook member and post for securing the hook member in angular position relative to the post, the securing means comprising an arcuate arrangement of a gear thread on the cam member and a worm gear mounted on the post and engaging the gear thread for securing the cam member in a predetermined position of adjustment.

* * * * *